US006899772B1

(12) United States Patent
Morando

(10) Patent No.: US 6,899,772 B1
(45) **Date of Patent: *May 31, 2005**

(54) ALLOY MOLTEN COMPOSITION SUITABLE FOR MOLTEN MAGNESIUM ENVIRONMENTS

(75) Inventor: Jorge A. Morando, Cadiz, KY (US)

(73) Assignee: Alphatech, Inc., Cadiz, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,550

(22) Filed: Mar. 27, 2000

(51) Int. Cl.[7] ..... C22C 38/18
(52) U.S. Cl. ..... 148/325; 420/37
(58) Field of Search ..... 148/325, 321, 148/324; 420/37, 586, 588, 583

(56) References Cited

U.S. PATENT DOCUMENTS

| | | | | |
|---|---|---|---|---|
| 4,034,588 | A | | 7/1977 | Way et al. |
| 4,236,920 | A | | 12/1980 | Lampe et al. |
| 4,331,741 | A | | 5/1982 | Wilson |
| 4,363,660 | A | | 12/1982 | Wakita et al. |
| 4,435,226 | A | | 3/1984 | Neuhäuser et al. |
| 4,487,630 | A | | 12/1984 | Crook et al. |
| 4,560,408 | A | | 12/1985 | Wilhelmsson |
| 4,727,740 | A | | 3/1988 | Yabuki et al. |
| 4,880,461 | A | | 11/1989 | Uchida |
| 5,077,006 | A | | 12/1991 | Culling |
| 5,783,143 | A | | 7/1998 | Handa et al. |
| 6,004,507 | A | * | 12/1999 | Morando ..... 420/586 |

FOREIGN PATENT DOCUMENTS

| | | | |
|---|---|---|---|
| JP | 63 274740 | * | 11/1988 |
| JP | 01011947 | | 1/1989 |
| JP | 04028849 | | 1/1992 |
| JP | 04141553 | | 5/1992 |
| JP | 04221045 | | 11/1992 |
| JP | 04221047 | | 11/1992 |
| JP | 05179393 | | 7/1993 |
| JP | 832 5673 | * | 11/1996 |
| JP | 8325673 | * | 12/1996 |
| JP | 9049051 | * | 1/1997 |
| JP | 090 49051 | * | 2/1997 |
| JP | 11293410 | * | 10/1999 |
| WO | PCT/JP82/00338 | | 8/1982 |

* cited by examiner

*Primary Examiner*—Sikyin Ip
(74) *Attorney, Agent, or Firm*—Charles W. Chandler

(57) ABSTRACT

A castable and machinable alloy suitable for submersion in a molten magnesium or magnesium aluminum melt has the following composition:

| ELEMENT | CONTENT (weight %) |
|---|---|
| Boron | 0.01–2.0 |
| Carbon | 0.01–2.0 |
| Sulphur | Trace |
| Phosphorus | Trace |
| Chromium | 5.0–15.0 |
| Silicon | 0.0–2.0 |
| Molybdenum | 2.00–12.00 |
| Tunsten | 0.5–10.00 |
| Vanadium | 0.5–5.0 |
| Niobium | 0.5–5.0 |
| Cobalt | 0.5–10.0 |
| Iron | Balance |

The alloy is resistant to dissolution by the melt at temperatures of up to around 1800° F.

1 Claim, 11 Drawing Sheets

A.A. Nayeb-Hashemi and J.B. Clark, 1991

| Phase | Composition, wt% Ni | Pearson symbol | Space group |
|---|---|---|---|
| (Mg) | 0 | *hP*2 | $P6_3/mmc$ |
| $Mg_2Ni$ | 54.7 | *hP*18 | $P6_222$ |
| $MgNi_2$ | 82.9 | *hP*24 | $P6_3/mmc$ |
| (Ni) | 100 | *cF*4 | $Fm\bar{3}m$ |

Mg-Ni

A.A. Nayeb-Hashemi and J.B. Clark, 1988

| Phase | Composition, wt% Mn | Pearson symbol | Space group |
|---|---|---|---|
| (Mg) | 0 to 2.2 | *hP*2 | $P6_3/mmc$ |
| (αMn) | 100 | *cI*58 | $I\bar{4}3m$ |
| (βMn) | 100 | *cP*20 | $P4_132$ |
| (γMn) | 100 | *cF*4 | $Fm\bar{3}m$ |
| (δMn) | 100 | *cI*2 | $Im\bar{3}m$ |

Mg-Mn

A.A. Nayeb-Hashemi and J.B. Clark, 1988

| Phase | Composition, wt% Si | Pearson symbol | Space group |
|---|---|---|---|
| (Mg) | ~0 | *hP*2 | $P6_3/mmc$ |
| $Mg_2Si$ | 36.61 | *cF*12 | $Fm\bar{3}m$ |
| (Si) | ~100 | *cF*8 | $Fd\bar{3}m$ |
| **High-pressure phases** | | | |
| $Mg_2Si$(a) | 36.61 | ... | ... |
| SiII | 100 | ... | ... |

(a) Above ~2.5 GPa and 900 °C, it forms a hexagonal structure.

ALLOY MOLTEN COMPOSITION SUITABLE FOR MOLTEN MAGNESIUM ENVIRONMENTS

BACKGROUND OF THE INVENTION

The present invention relates to the metal processing arts. It finds particular application in conjunction with mechanical equipment for moving or pumping metals, such as magnesium, aluminum, and zinc, in a bath of molten metal, and will be described with particular reference thereto. An alloy is provided which is particularly suited to forming components for use in magnesium and magnesium/aluminum baths for refining of magnesium, at temperatures up to around 1800° F. Such components include, for example, pumps, tubing, ladles, troughs, rolls, drivers, furnace, equipment, risers, and the like. It should be appreciated, however, that the invention is also applicable to a variety of metal processing industries in which the processing equipment is submerged in a bath of molten metals.

Baths of molten metals, such as magnesium, zinc, and combinations of magnesium and aluminum or zinc and aluminum are widely used in the metal processing industries. To retain the metals in their molten state, bath temperatures of up to 1300° F. for zinc-rich baths and 1800° F. for magnesium-rich baths are typically encountered.

Equipment used for moving and transferring metals in a bath of molten metal, conventionally have a relatively short life because of the destructive effects of the molten metal on the components contacting the molten metal. Pump shafts, for example, connecting a motor to an impeller, are often formed of steel to provide sufficient torque to move the impeller and the molten metal. Such shafts tend to have a short life because the steel is chemically attacked by the molten metal. If the steel shaft is shielded by a protective coating of a ceramic material, the different thermal-expansion characteristics of the steel and the ceramic tend to cause the ceramic to shatter in a relatively short time. Parts made of graphite rather than steel tend to burn at the metal surface. Pure ceramic components do not have sufficient tensile torque or impact strength to overcome the stresses normally encountered when utilized in molten metals.

Hot dip metalizing coating processes for galvanizing steel used in the automotive, construction, and appliance industries also require equipment that runs submerged in a molten metal. Strips of steel to be galvanized are passed around a sink roll in a molten bath of zinc [galvanizing], aluminum [aluminizing], or aluminum-zinc [galvanneal] in which the levels of aluminum vary from a fraction of a percent to as much as 100 percent. The molten metal temperature is of the order of 820° F. to as high as 1300° F.

Standard rolls and equipment used in magnesium processing, where the molten metal is 95–100% magnesium, are generally formed from cast iron or mild steel. Pumps and bearings, in particular, require continuous replacement and maintenance. Often, the equipment components are removed and replaced weekly, and in some cases, daily. Cast iron and mild steel are not formulated specifically for these applications and consequently lack the properties to meet the operational needs. A suitable alloy for fabrication of molten metal equipment, such as power-driven pumps and bearings should have the following desirable characteristics:

1. Low solubility in the molten magnesium. In other words, a material loss of less than $10^{-7}$ cm/hour.
2. Low adhesion (non-wettable) to Mg and Mg salts and dross. Wetting plays the main role in the bonding of solid-liquid state metals.

3. High surface hardness ($R_c$ larger than 30). Abrasive wear contributes nearly half of the loss of bearing life in smelting applications.
4. Dimensional stability at operating temperatures of up to 1500° F. for straightness and roundness. Pumps that operate over 1000 RPM tend to generate excessive vibration and damage to the bearings and holding equipment when dimensional stability is low.
5. Thermal shock resistance. The equipment should be capable of withstanding a shock of no less than 700° F. when going from air to molten metal and 1400° F. when going from molten metal to air.
6. Good impact and notch resistance strength.
7. Castable and machinable by standard procedures to provide simple and available maintenance.
8. Tensile strength and elastic modulus compatible with the application.

The present invention provides a new and improved alloy suited to used in advanced molten magnesium handling equipment, galvanizing equipment, and other equipment to be submerged or partially submerged in molten metals, which overcomes the above-referenced problems and others.

SUMMARY OF THE INVENTION

In accordance with one aspect of the present invention, an alloy suitable for use in fabricating a component to be used in molten melts which include magnesium is provided. The alloy includes iron, chromium, molybdenum, vanadium, niobium, cobalt, and tungsten, and at least one of boron and carbon.

Preferably, the alloy is essentially free of phosphorus and sulfur, and includes, in terms of weight percent:

| | |
|---|---|
| Boron | 0.01–2.0 |
| Carbon | 0.01–2.0 |
| Chromium | 5.0–15.0 |
| Silicon | 0.0–2.0 |
| Molybdenum | 2.0–12.00 |
| Tungsten | 0.5–10.00 |
| Vanadium | 0.5–5.0 |
| Niobium | 0.5–5.0 |
| Cobalt | 0.5–10.0 |

In accordance with another aspect of the present invention, a component formed from the alloy is provided.

In accordance with another aspect of the present invention, a method of forming a component for submersion in a magnesium melt is provided. The method includes forming the component from the alloy of the present invention.

In accordance with another aspect of the invention, a method of inhibiting dissolution of a component of equipment in a molten melt comprising magnesium is provided. The method includes 1) forming the component from an alloy which includes, in terms of weight percent:

| | |
|---|---|
| Boron | 0.01–2.0 |
| Carbon | 0.01–2.0 |
| Chromium | 5.0–15.0 |
| Silicon | 0.0–2.0 |
| Molybdenum | 2.0–12.00 |

-continued

| | |
|---|---|
| Tungsten | 0.5–10.00 |
| Vanadium | 0.5–5.0 |
| Niobium | 0.5–5.0 |
| Cobalt | 0.5–10.0 and |

2) contacting the component and the melt.

One advantage of the present invention is that the alloy has a high tensile strength at temperatures suited for immersion in a molten metal bath.

Another advantage of the present invention is that it has a high compression yield.

A further advantage of the present invention is that it is able to withstand immersion in molten metal baths for extended periods, including freezing and remelting of the bath.

Yet a further advantage of the present invention is a reduction in the pick-up of alkalides on the exterior of the alloy during clean-up following a remelt.

Still further advantages of the present invention will becom apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

A high strength alloy of iron includes boron, carbon, chromium, silicon, molybdenum, tungsten, vanadium, niobium, cobalt, in addition to iron. The alloy is preferably substantially free of traces of nickel. It is preferably essentially free of sulphur and phosphorus, containing these elements in no more than trace amounts. The alloy is suited for use in fabricating components for immersion or partial immersion into molten metal baths.

While the alloy is described with specific reference to components for molten metal pumps used in molten magnesium baths, it is to be appreciated that the alloy is suited to the fabrication of a variety of equipment for processing and handling molten magnesium, for use in magnesium and other molten metal baths.

Figure 1:
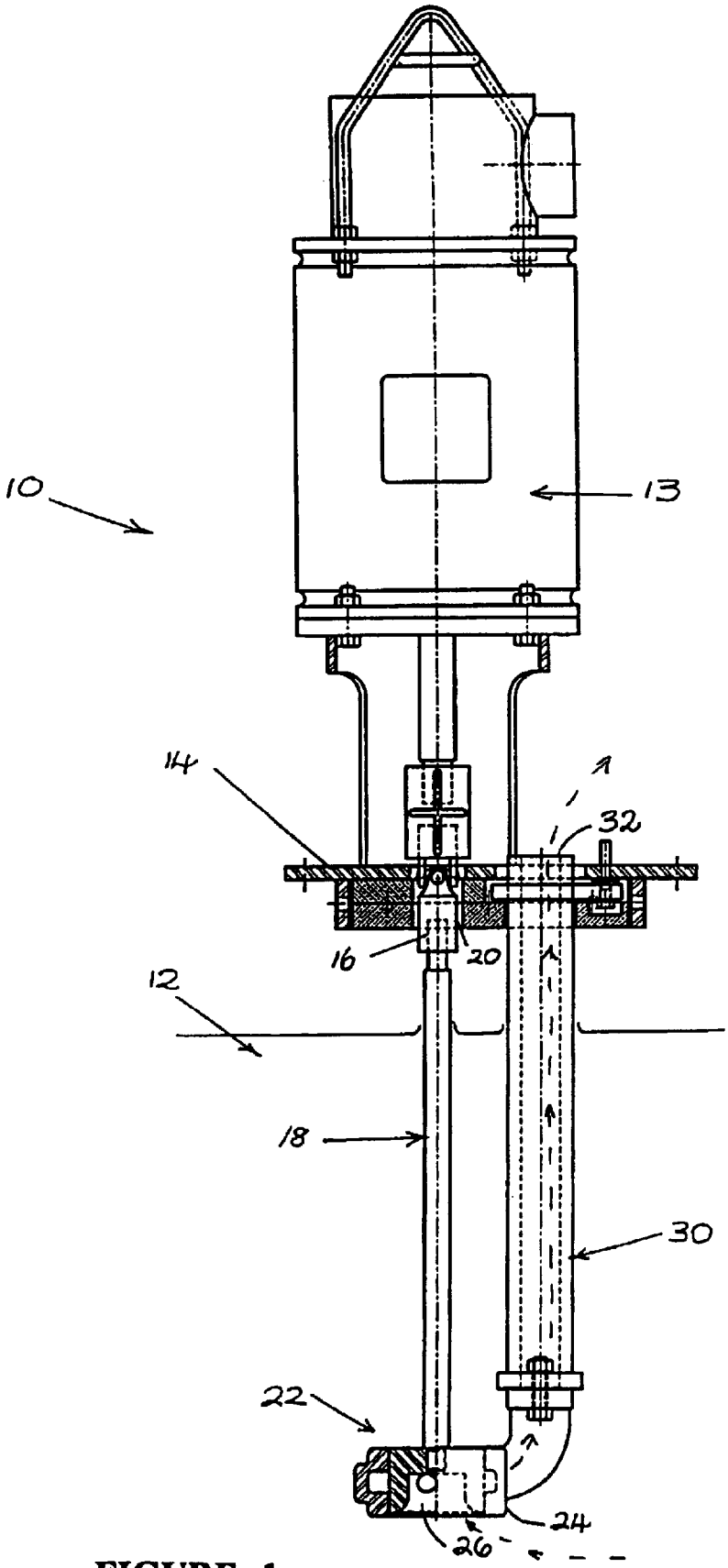
FIG. 1 is an exploded perspective view of a molten metal pump according to the present invention.

With reference to FIG. 1, a impeller pump 10 having a lower pumping end to be disposed in a bath of molten metal 12, such as magnesium or magnesium and aluminum, is shown. The bath operates at temperatures up to about 1800° F. An electrically driven motor 13 is supported in a suitable location above a pump cover plate 14. The motor is connected by a coupling 16 to a pumping or driving shaft 18. The coupling is supported in an opening 20 in the pump cover plate. The lower end of the shaft is disposed in the bath of molten metal.

A base assembly 22 includes a housing 24 and a pumping member 26 comprising an impeller (not shown) disposed in the housing. The shaft is drivingly connected to the pumping member to rotate it in the housing in order to produce a stream of molten metal that enters the housing adjacent the floor. The molten metal passes into a riser 30 and moves upward, toward an outlet opening 32.

Coupling 16 forms a connection between the motor and shaft assembly 18 that rotates the pumping member 26. The shaft has a sufficient torque characteristic for driving the impeller in molten metal. One or more posts or legs (not shown) are optionally mounted between the pump housing 24 and the cover plate 14 in order to lock the pump leg to the housing without the use of load-carrying cements.

Parts of the pump which are subjected to the molten metal, including the pumping member and associated impellers, bearings, and the like, support posts, and shaft, are formed from an alloy of iron in accord with the general formula including:

| ELEMENT | CONTENT (weight %) |
|---|---|
| Boron | 0.01–2.0 |
| Carbon | 0.01–2.0 |
| Chromium | 5.0–15.0 |
| Silicon | 0.0–2.0 |
| Molybdenum | 2.0–12.00 |
| Tungsten | 0.5–10.00 |
| Vanadium | 0.5–5.0 |
| Niobium | 0.5–5.0 |
| Cobalt | 0.5–10.0 |

The composition is essentially free of sulfur and phosphorus, containing preferably no more than trace amounts of these elements. The balance is preferably iron, although amounts of other alloying elements may be included.

More preferably, the alloy has the following composition:

| ELEMENT | CONTENT (weight %) |
|---|---|
| Boron | 0.20–0.30 |
| Carbon | 0.50–0.60 |
| Sulfur | 0.000–0.005 |
| Phosphorus | 0.000–0.005 |
| Chromium | 10.0–11.0 |
| Silicon | 0.0–0.80 |
| Molybdenum | 6.00–7.00 |
| Tungsten | 3.00–3.50 |
| Vanadium | 2.00–2.40 |
| Niobium | 2.80–3.20 |

-continued

| ELEMENT | CONTENT (weight %) |
|---|---|
| Cobalt | 4.00–4.50 |

and is substantially free of nickel. In this preferred formulation, the composition has a material hardness ($R_c$) of about 35–40.

The composition is selected to provide a super alloy which is resistant to surface dissolution by magnesium in molten metal baths at temperatures up to at least their melting temperatures, and preferably to temperatures of at least 100–200° F. above the melting temperature. Pure magnesium melts at a temperature of about 1200° F. It is readily formed into pump components by casting, molding and other conventional techniques, and has a sufficient tensile strength to withstand the normal stresses encountered by equipment operating in a molten metal bath. The composition is also suited for forming rolls and equipment used in "hot dip" metalizing processes.

Without wishing to limit the invention, the following theories and experimental data were taken into consideration in formulating the alloy composition.

A. Evaluation of Specification Requirements

In order to devise a material formulation that is capable of having a dissolution rate of $$O=S<10^{-7}\ cm/\text{hour},$$

where, S=the amount of alloy loss due to molten metal dissolution, it is important to understand the interaction of dissimilar metals in solid-liquid states. The joining of dissimilar metals in a solid-liquid state is governed by their physico-chemical properties and by the interaction between them; or, in the case of more complex systems, such as super alloys, by their interaction with all other alloying elements and impurities. When the melting point of the corrosive metal (the molten magnesium in this case) is much lower than that of the metal being attacked (the component alloy), the component alloy remains in a solid state throughout the process.

Experimental as well as theoretical findings suggest that the attack on a solid metal by magnesium is a topochemical reaction in which a two-stage formation of strong bonds between atoms of the two materials is a characteristic feature.

In the first stage, a physical contact is established by the close proximity of the two metals allowing interaction between the atoms. The electro-static interaction between the surface atoms is of great importance in this stage.

In the second stage, the chemical interaction takes place and the formation of a strong bond is completed. In this stage, quantum processes between the electrons prevail. Thus, the occurrence of electron interaction of different types of materials requires a definite quantity of energy for surface activation. This energy, in the case of magnesium smelting, is imparted in the form of heat retained in the molten metal that is maintained at temperatures well above its melting temperature in order to improve the reaction capability of the melt in accelerated smelting. In other words, the lower the temperature of the melt in the pot, the slower the two basic stages of alloying formation.

Both stages, as well as the subsequent diffusion, take place so fast that it is difficult to join magnesium to steel without the formation of brittle intermetallic layers at the contact zone. Magnesium alloys are so active that adhesion and diffusion into most metals or stainless steel is achieved even in the presence of a passive film of oxides.

Utilizing metals or transition metals with a saturation concentration ($C_s$) equal to 0 at the operating temperature of the melt, would result in a non-wetting, zero-solubility alloy for operation in the magnesium melt. Five such materials exist for magnesium, namely boron, carbon, vanadium, and niobium. This can be appreciated by reference to phase diagrams for elements and mixtures of elements. FIGS. 2–11 show phase diagrams for Mg—Ni, Mg—Mn, Mg—Si, Cr—Fe, Mg—Mo, Mg—Co, Mg—B, Mg—V, Mg—Nb, and Mg—Fe, respectively, taken from the prior art. Other phase diagrams are reprinted, for example, in "Phase Diagrams of Binary Magnesium Alloys," "Handbook of Ternary Alloy Phase Diagrams," and "Binary Alloy Phase Diagrams."

However, even with an understanding of solubility parameters, careful control of the composition formulation is desirable to provide other performance properties, such as those previously outlined.

It has thus been beneficial to study the dissolution coefficient for metals and transition metals, and its change with changes in operating temperatures, and establish its variation in value for binary and ternary alloys. Attempts have been made to establish a correlation between theoretical values of the dissolution coefficient, with available experimental values (Mitsuo Niinomi and Masamichi Sano, Dissolution of Ferrous Alloys into Molten Aluminum, Transaction of the Japan Institute of Metals, Vol. 23, No. 12). It has been established that the kinetics of dissolution of metals and transition metal alloys in magnesium and zinc/aluminum melts do not follow theoretically-derived dissolution rate curves, such as the Nernst/Shchukarev equation. The differences of the dissolution coefficients obtained may be attributed to:

a. The mechanism of dissolution (static, natural convection, dynamic, etc.)

b. The relationship to the appearance and growth peculiarities of the intermetallic phases formed at the interface of the solid and liquid metals. The growth of these intermetallic phases in certain melts, as discussed earlier, is extremely fast. Their growth decreases the dissolution rate, and with $C_s$ and surface area values constant, the value of $K_s$ (a time dependent coefficient which establishes the kinetics of dissolution of a component element of the alloy) thus decreases with time to a value below the theoretical value. Finally, the dissolution process changes to an intermetallic layer/alloy melt diffusion controlled process. This occurs when the critical thickness of the intermetallic layer is reached and dissolution reaches equilibrium.

Perhaps the most valuable information is that derived from the following facts:

a. Magnesium does not attack or wet most oxides, carbides, borides or nitrides.

b. At steady-state equilibrium, $K_s$ is no longer a variable function of time ($K_s$=f(t)), but a constant.

c. The investigations of V. R. Ryabov, (Alitirovanie Stali, Chapter IV, Metalurgiya Publishers, Moscow) on how the addition of other elements to iron and concentration of these elements affects the diffusion zone, formation of intermetallics, and change in the dissolution rate.

The following conclusions can be drawn.

1. Carbon

The structure of iron-carbon alloys formed by slow cooling from the γ-solid solution region is well known. Magnesium decreases the solubility of carbon in liquid and solid iron. As a hot melt containing magnesium dissolves the surface layers of the test component, carbon is forced out from the solid solution of iron and moves progressively ahead of the interface and diffusion zone between the melt and the component. An area rich in carbon develops immediately in front of the diffusion zone. The carbon acts as a barrier layer which inhibits further dissolution of the component.

2. Nickel

Nickel belongs to the group of those elements forming a continuous series of solid solutions with iron. Introduction of nickel into iron widens the γ-Fe region. Nickel has very high $C_s$ in magnesium and its addition is equivalent to an increase in temperature of the alloy melt.

Figure 2:
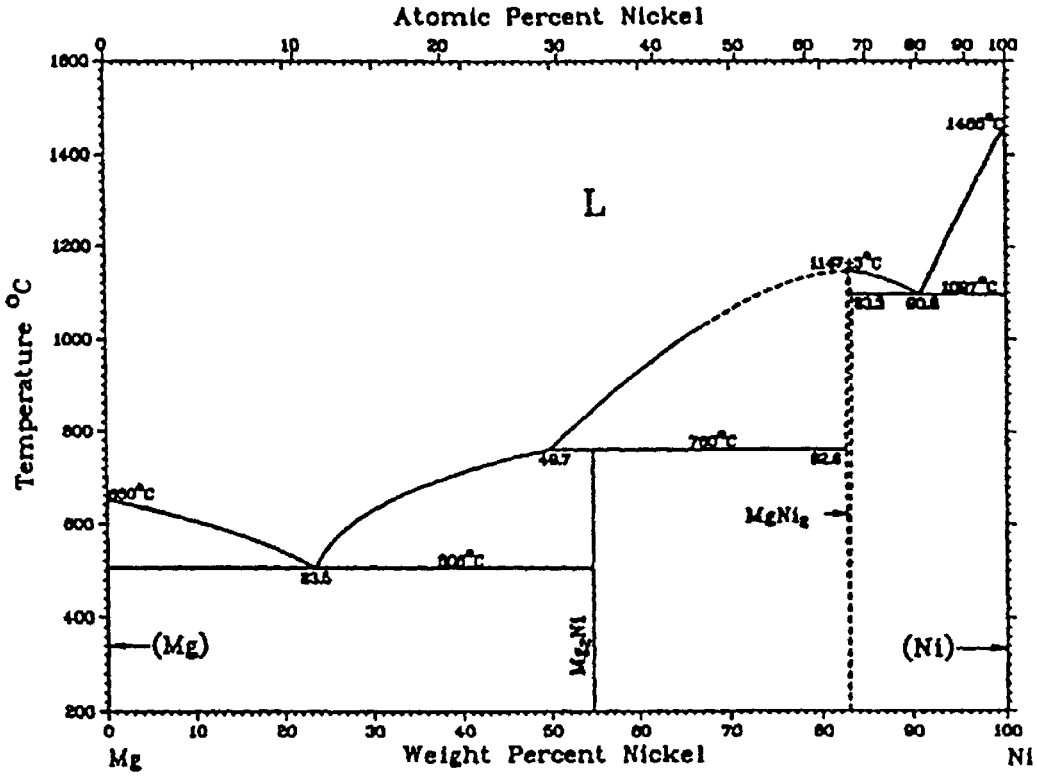
FIG. 2 is a binary phase diagram for a nickel magnesium alloy.

FIG. 2 shows a binary phase diagram for nickel magnesium alloys.

3. Chromium

Figure 5:
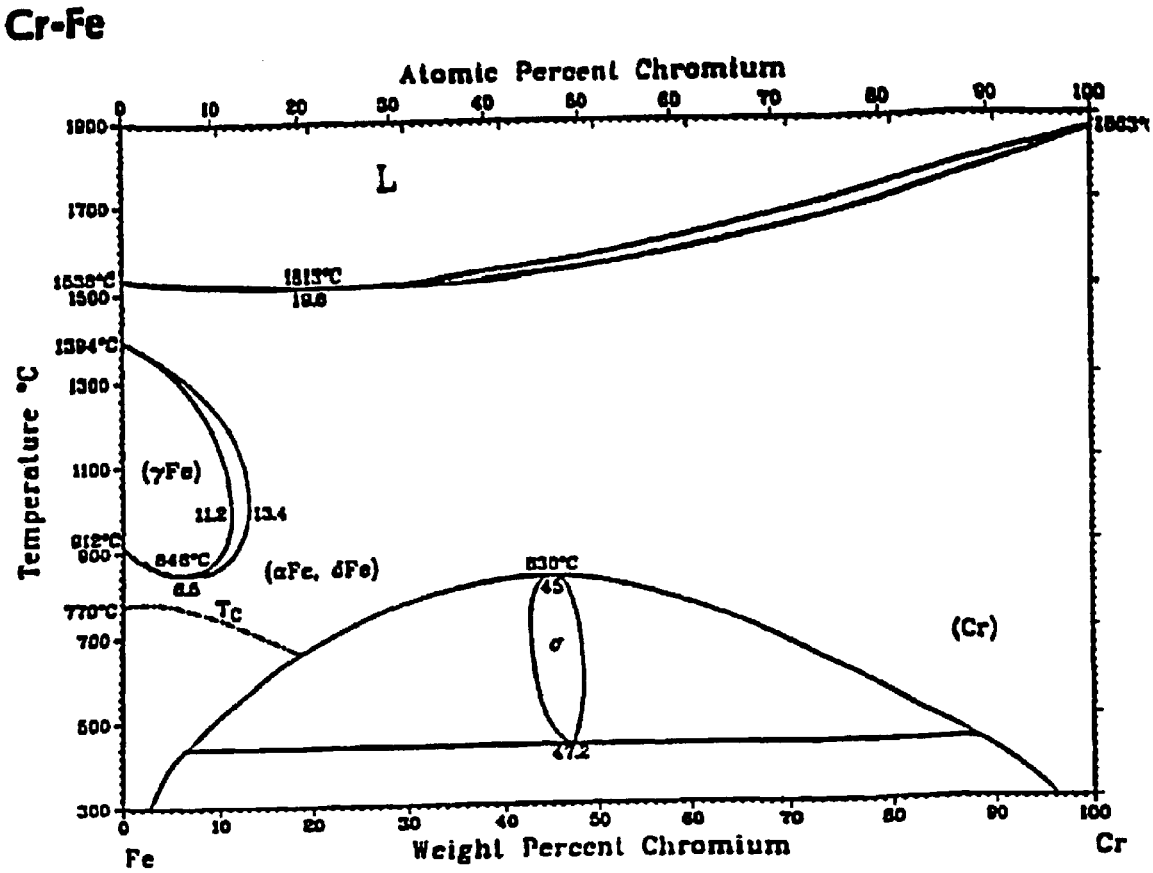
FIG. 5 is binary phase diagram for a chromium iron alloy.

Chromium belongs to the group of alloying elements, which narrow the γ-region. The chosen chromium content and the magnesium temperature do not alter the region of phase changes, as can be seen in the iron-chromium phase diagram (FIG. 5).

4. Manganese

Manganese is one of the alloying elements which widens the γ-region, behaving very much like nickel. A continuous series of solid solutions does not appear in a solid state in the iron manganese system.

The thickness and hardness of the intermetallic zone decrease with an increase in manganese content in the steel substrate thus increasing the dissolution coefficient, $K_s$.

Figure 3:
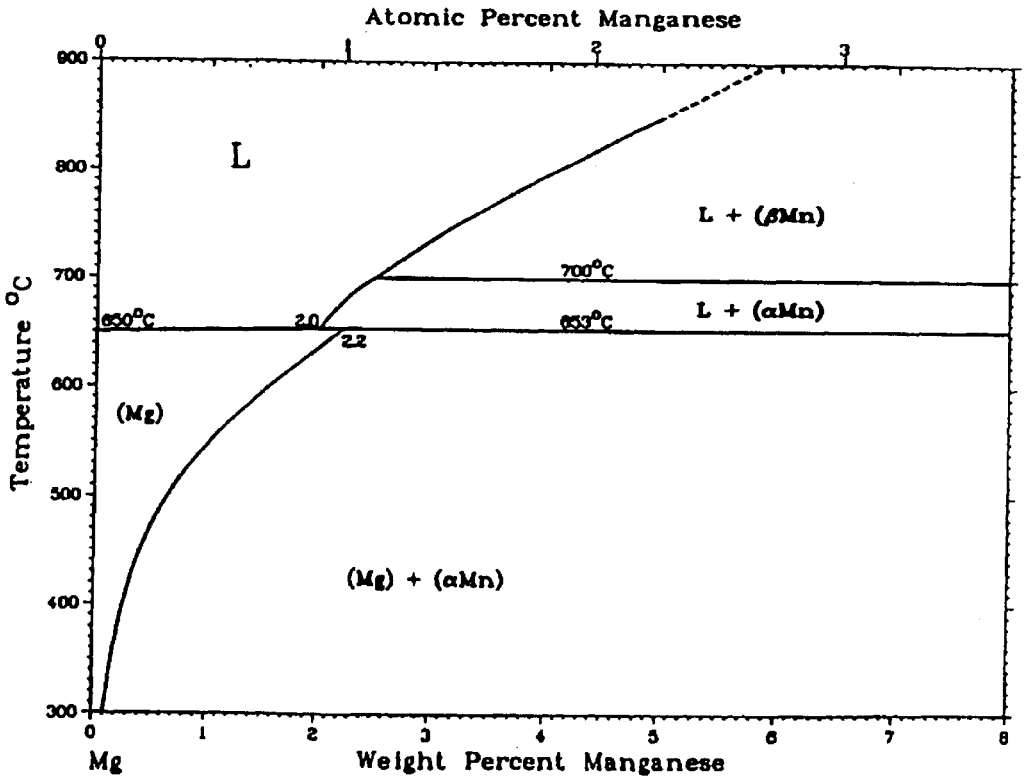
FIG. 3 is a binary phase diagram for a manganese magnesium alloy.

FIG. 3 shows a binary phase diagram for manganese magnesium alloys.

5. Silicon

Although, silicon belongs to those elements which narrow the γ-region, it behaves in a more detrimental manner because of its high $C_s$ in the molten magnesium melt and a reduction in the melting temperature of the magnesium melt as the silicon percentage increases.

An additional problem with silicon is that it does not generate carbides at the standard processing temperature in the way that vanadium, tungsten, and niobium do.

Figure 4:
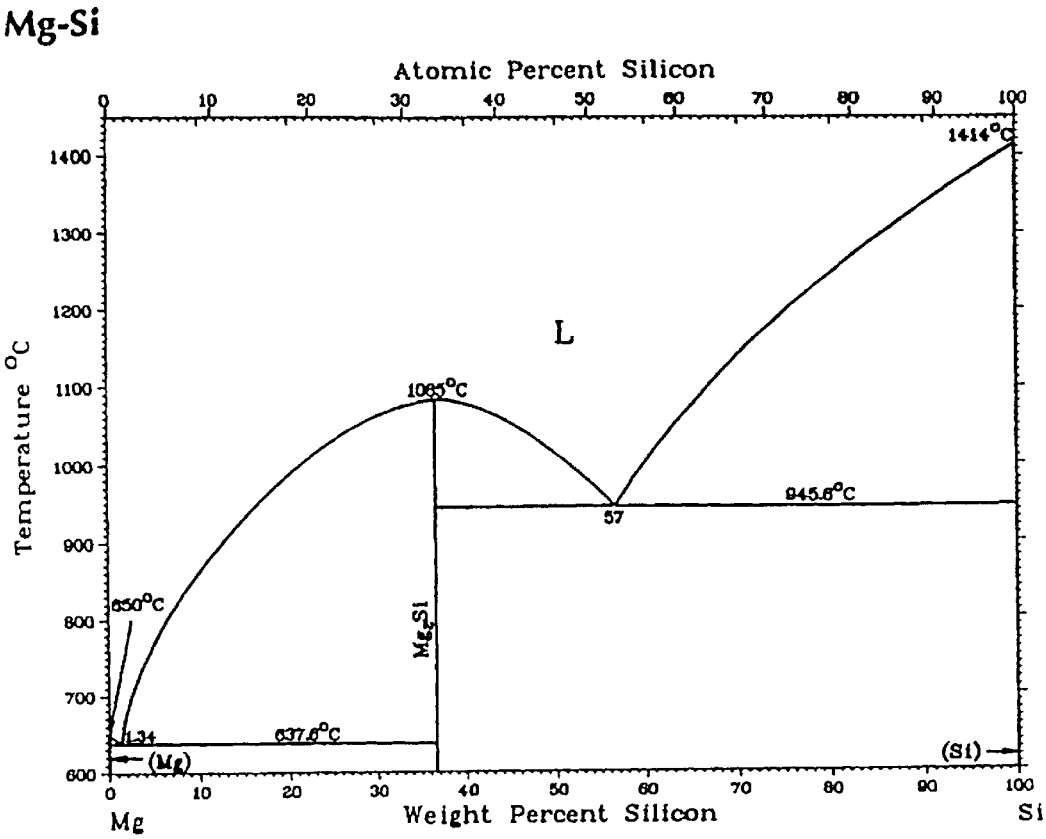
FIG. 4 is a binary phase diagram for a silicon magnesium alloy.

FIG. 4 shows a phase diagram for silicon magnesium alloys.

6. Boron

Boron very strongly narrows the γ-region. There are only two mechanisms by which a crystal can dissolve atoms of a different element: interstitial and substitutional. Boron and carbon are the only elements with atoms small enough to fit into the interstices of iron crystals. The other small-diameter-atom elements, such as oxygen, hydrogen and nitrogen, tend to form compounds with metals instead of dissolving in them. The addition of boron and carbon creates a strong increase in the crystal's internal energy, strengthening the alloy and reducing its solubility in the molten magnesium melt.

7. Titanium, Vanadium, and Molybdenum

Phase changes in iron-titanium alloys set in only above 900° C. An introduction of titanium in iron strongly narrows the γ-region.

Figure 6:
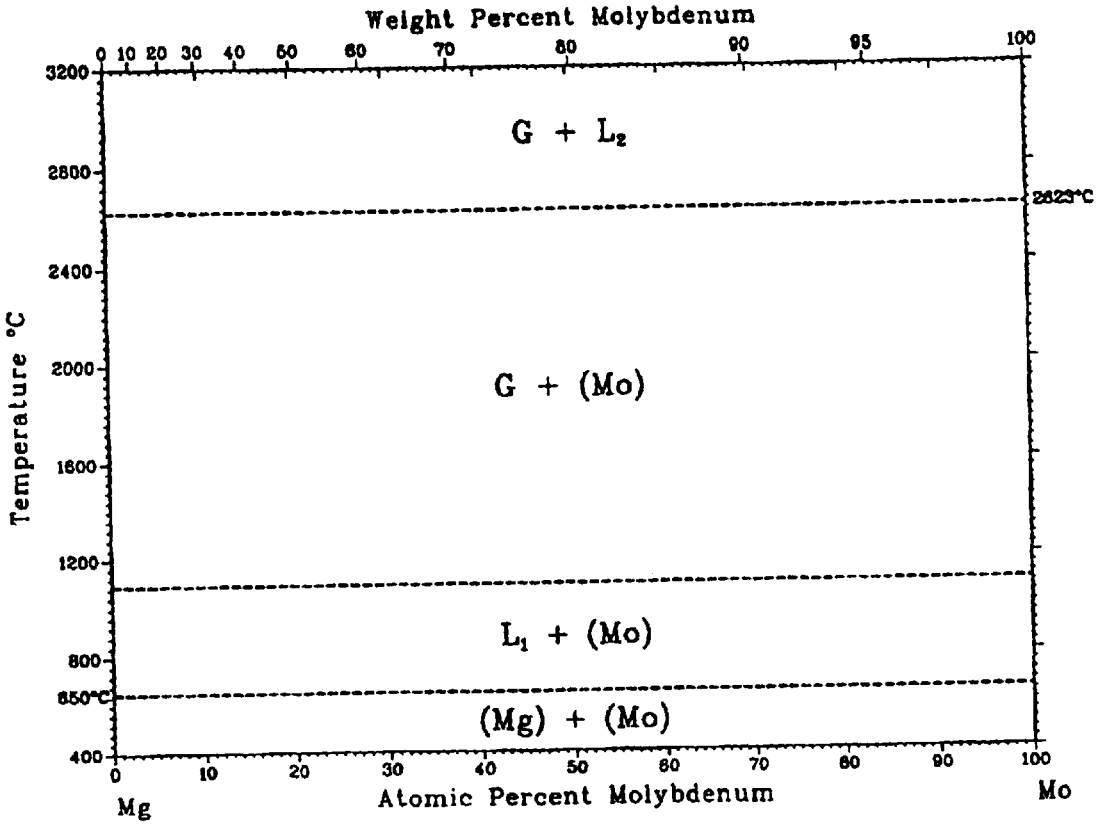
FIG. 6 is a binary phase diagram for a molybdenum magnesium alloy.

Vanadium and molybdenum drastically limit the γ-region. FIG. 6 shows a binary phase diagram for magnesium with molybdenum.

8. Cobalt

Figure 7:
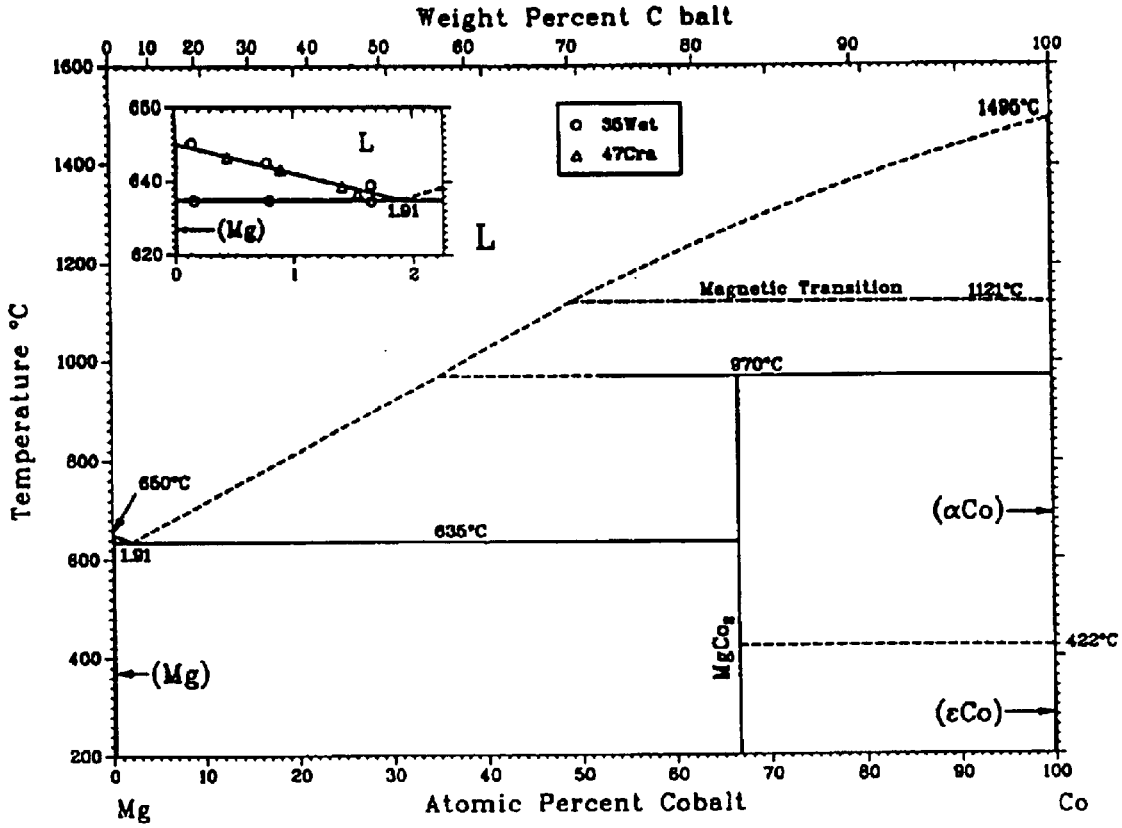
FIG. 7 is a binary phase diagram for a cobalt magnesium alloy.
Figure 8:
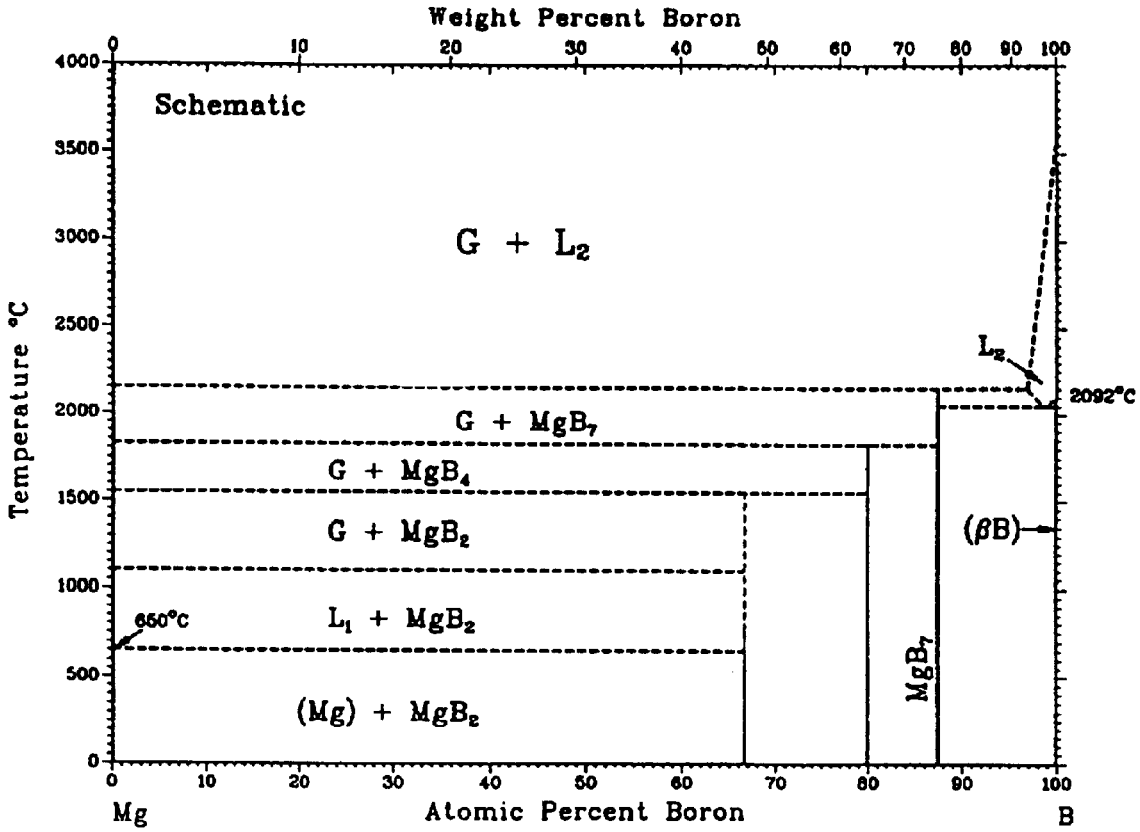
FIG. 8 is a binary phase diagram for a boron magnesium alloy.
Figure 9:
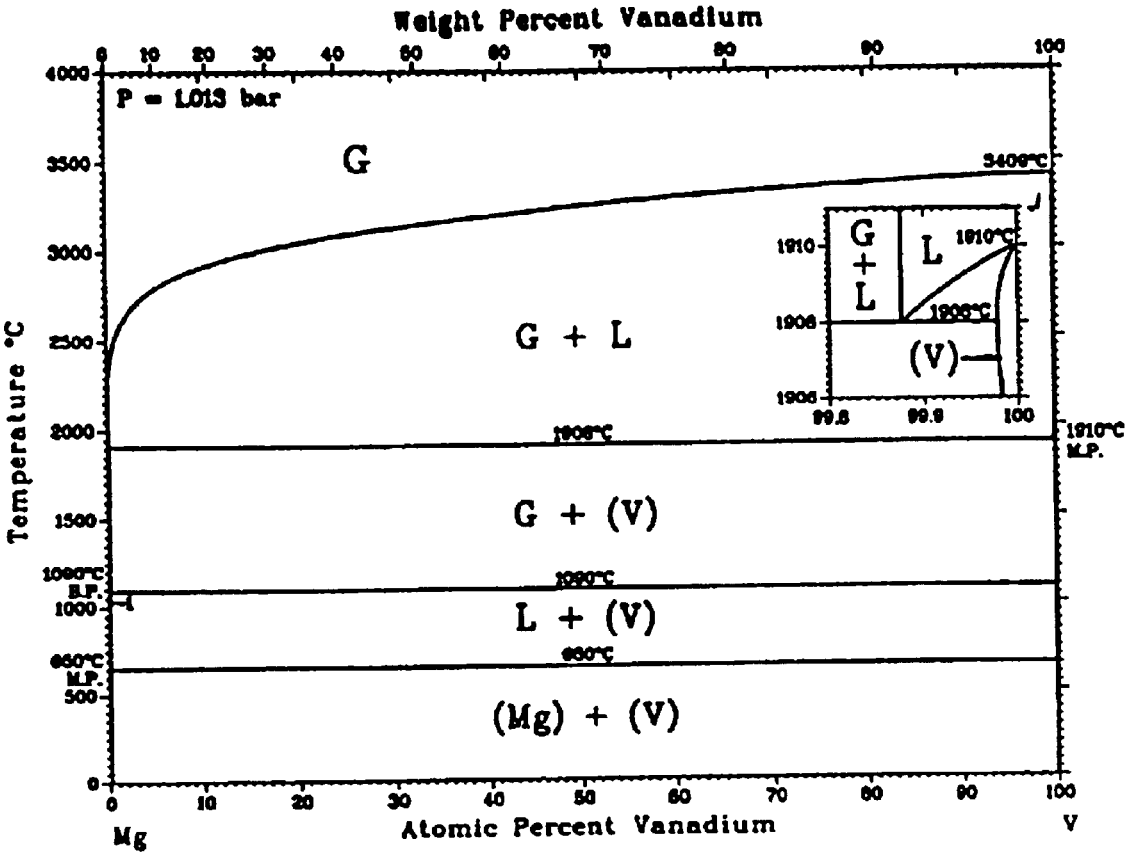
FIG. 9 is a binary phase diagram for a vanadium magnesium alloy.
Figure 10:
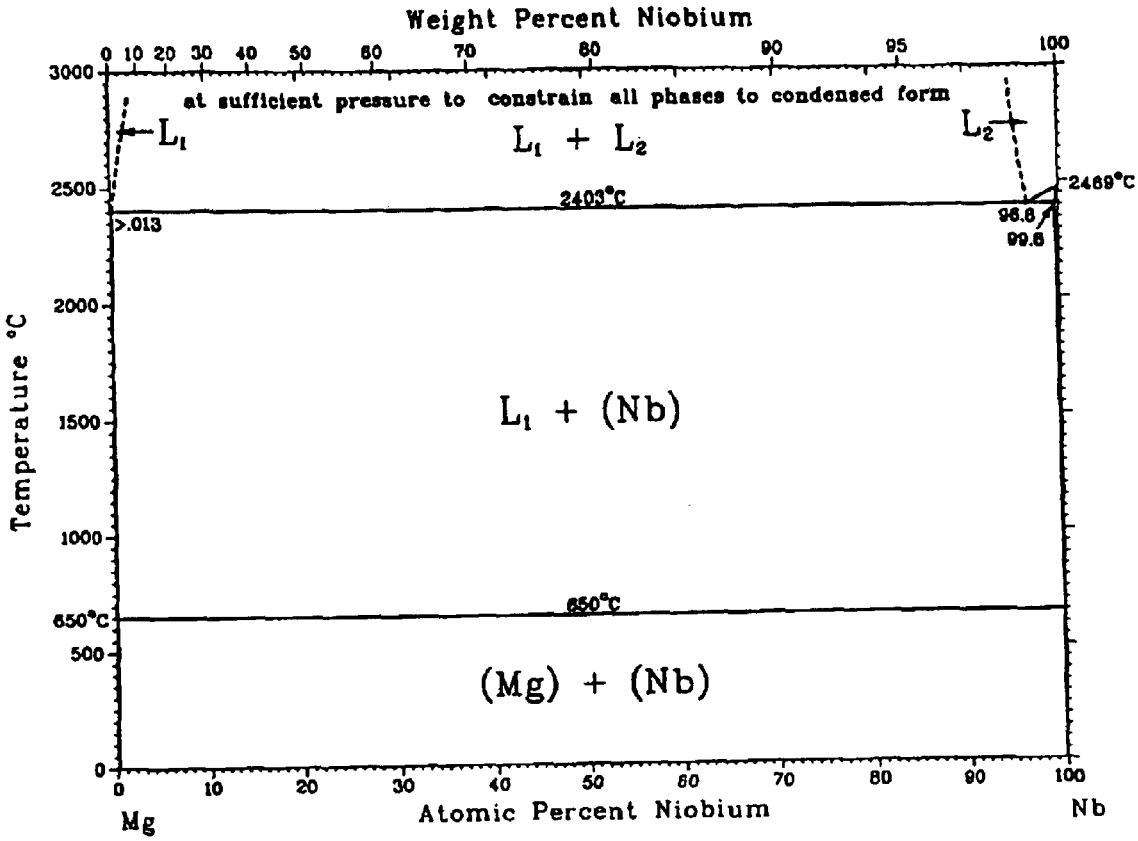
FIG. 10 is a binary phase diagram for a niobium magnesium alloy.
Figure 11:
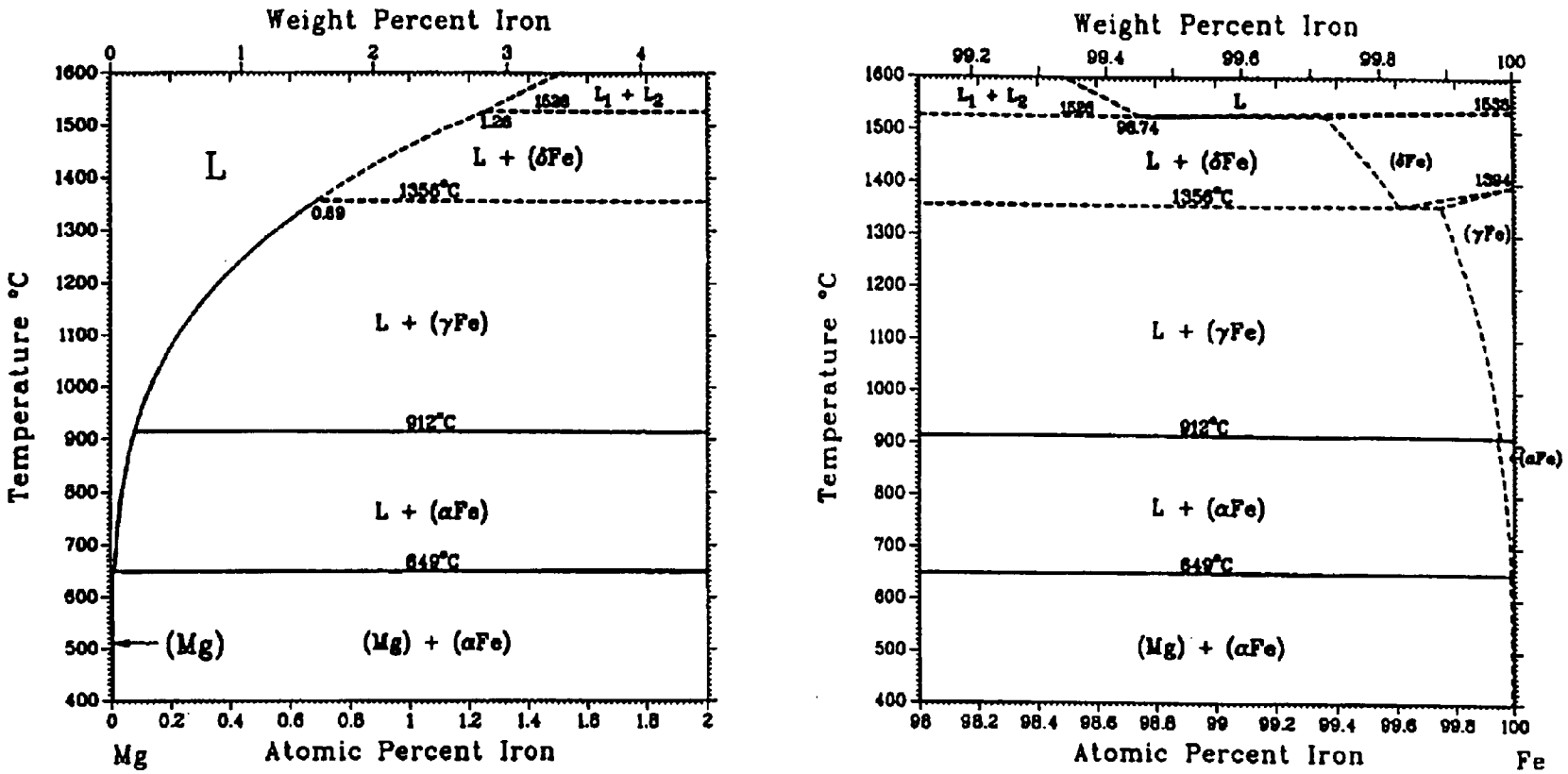
FIG. 11 is a binary phase diagram for an iron magnesium alloy.

FIG. 7 shows the binary phase diagram for cobalt with magnesium. Iron and cobalt are used to form the solution matrix in conjunction with some of the chromium (approximately 60%) and molybdenum and tungsten that do not become carbides.

B. Component Element Selection Criteria

All the elements which increase the thickness of the diffusion layer and reduce the mass transfer rate narrow the field of the γ-modification in the iron alloying element phase diagram. The elements acting in the opposite manner widen the γ-region. This occurs because the diffusion rate of different elements in the α-modification of iron with a bcc (Body-centered cubic) structure is greater than in the γ-modification, with an fcc (Face-centered cubic) structure (V. R. Ryabov and V. D. Duplyak, Protective Coatings on Metals, Naukova-Domka Kiev No. 5, pp. 89–94 (1968)).

From the kinetics of formation of the diffusion layer and growth in thickness and properties of the intermetallic layers between solid-liquid phases, it can be concluded that if a metallic alloy is to be formulated to resist magnesium melts, it should preferably meet the following requirements:

a. The components of the alloy should have the lowest saturation concentration possible, i.e., $1\% > C_s = 0$ at the melt operation temperature.

b. The alloying elements should narrow the γ-Fe region, and their percentage content should be such that only the γ-region is covered at the operational temperature.

c. Elements that reduce the melting temperature of magnesium should be limited or avoided as components of the melt-resistant alloy. In other words, $$1\times10^{-2}1/^\circ C > dc_s/dT \geqq 0$$

d. The formation of strong, covalent-bonded molecules of the type $M_xC_y$ should be promoted to generate a microstructure rich in hard and steady carbides, resistant to molten magnesium, having tough complex matrix structures.

e. Maximization of the carbides to matrix ratio should be secured by proper selection of the carbon ration to carbide forming elements, thus, also assuring a reduction of the exposed effective area.

Based on the preceding studies and conclusions, the optimum components for alloys to used in a magnesium-based melt include: boron, carbon, cobalt, chromium, molybdenum, niobium (columbium), titanium, vanadium, tungsten, and zirconium.

The alloy of the present invention is also preferably non-wettable to magnesium and its dross. Surface phenomena play a decisive roll in the formation of strong bonds (J. A. Morando, U.S. Pat. No. 5,338,280, Columns 1 and 2). Data and analyses performed suggest that the work of adhesion of metals and transition metal alloys decreases with increases in the surface hardness and a reduction of surface energy of the adhesion-resistant alloy. This is due, perhaps, to the fact that the surface hardness of the resistant alloy is a consequence of the concentrations of low surface energy carbides (WC, MoC, VC, and the like) present on the alloy surface.

By formulating a material based on the restraints of the selected criteria, the mass transfer rate is reduced with the increase in complexity of the intermetallic layer and with a decrease in the bonding strength of the diffusion layer, as a consequence of the minimization of matrix exposure and reduction of exposed effective area.

A high surface hardness ($R_c$ larger than 30 is also preferred, for bearings in particular. This is a mechanical consideration imposed by the fact that the bearing surface is acting as the load carrier and sliding friction between the stationary and moving bearing areas will occur during operation. The wear caused by this sliding friction can be greatly reduced if the material hardness $R_c$ is above 30. One of the many reasons for the poor performance of mild steel is that it cannot take any surface loading at the melt operating temperature and it therefore fails due to abrasive wear. Cast iron loses it's strength rapidly with temperature with somewhat similar, although marginally better results.

The materials formulated in accord with the selection criteria, because of the high carbide densification and distribution as well as the toughness of the solid solution matrix that contains them, have shown excellent dimensional stability at temperatures up to 1600° F. and above.

Thermal shock resistance and impact resistance are achieved by utilization of a combination of iron and cobalt to form the solid solution matrix that will contain the carbides as outlined in the discussion of the selection criteria.

For good shock resistance, the nickel concentration is as low as possible, preferably 0%.

C. Alloy Compositions

The alloy includes iron and preferably the following alloying elements: boron, carbon, chromium, molybdenum, tungsten, vanadium, niobium, and cobalt. The composition may also contain small amounts of silicon or manganese to aid in the casting fabrication of components.

Carbon reacts with alloying elements in the alloy and with iron to form carbides. The nature of the specific carbides formed influences the characteristics of the surface layer of the alloy. Iron carbides tend to be brittle. Other carbides, such as those of chromium, molybdenum, tungsten, vanadium, niobium and cobalt provide improvements in the properties of the alloy. If the carbon concentration is too high, grinding of the alloy becomes difficult.

The concentration of carbon is preferably below 2.0%. Preferably the concentration of carbon is in the range 0.40–1.2%. A carbon concentration in the range 0.50–0.60% is particularly preferred.

Boron reacts with alloying elements and iron to form borides. Boron provides the alloy with a resistance to the molten metal equivalent to a doubling of the carbon content without a concomitant loss of corrosion resistance. Thus the presence of boron is desirable, particularly in those parts which are at the interface between molten metal and the atmosphere above, where corrosion is most likely. Parts which are submerged in the melt are not so subject to corrosion and thus may contain lower concentrations of boron.

Preferably, the boron concentration is from 0.01–2.0 weight %. A concentration of boron in the alloy composition of 0.15–0.35% is preferred, with a particularly preferred concentration of 0.20–0.30%. Those parts which are at the interface between molten metal and the atmosphere above preferably contain a concentration of boron at a higher end of the range (around 0.30–0.50%) and may be correspondingly lower in carbon.

The composition preferably has a sulfur concentration of no more than trace amounts, preferably of below about 0.005%, more preferably, around 0.0%. Such trace amounts of sulphur do not unduly influence the properties of the composition and thus it is not necessary to eliminate sulphur altogether.

Preferably, the alloy composition has a phosphorus concentration of no more than trace amounts, preferably of below about 0.005%.

Chromium is preferably present in alloy composition in the concentration range 9.0 to 12.0%, most preferably 10.0 to 11.0% by weight. At higher chromium concentrations, the alloy tends to become brittle. Approximately 36% of the chromium present in the alloy is converted to carbides.

Silicon improves fluidity of the alloy during casting. However, it tends to reduce the melting temperature of the molten magnesium melt. The silicon content is thus preferably such that only the γ-region is covered at the melting temperatures, to improve fluidity during casting without unduly influencing its properties in the magnesium melt. According, it is preferred to keep the silicon concentration below about 1.0%, more preferably below about 0.8% by weight, and most preferably, the alloy is substantially free of silicon.

Molybdenum provides good high temperature resistance to the alloy. Its resistance does not change with temperature, thus it is desirable in components for immersion into magnesium baths where temperatures of 1800° F. are experienced. However, at high concentrations of molybdenum, the corrosion resistance is reduced. The alloy composition preferably includes molybdenum in the concentration range of 5.0–8.0%, and more preferably in the range 6.0–7.0%. For components which are likely to be positioned at the interface between the melt and the atmosphere above, where corrosion is most likely, molybdenum concentrations at the low end of the range, about 5.0–6.5% by weight, are preferred.

Cobalt increases thermal shock and impact resistance and provides good high temperature strength to the alloy. The alloy composition preferably includes 3.0–5.0% cobalt, more preferably 4.0–4.5% cobalt.

Tungsten provides similar properties to cobalt but forms an alloy that is easier to weld than an alloy which contains cobalt but no tungsten. The alloy composition preferably includes 2.5–4.0% tungsten, more preferably 3.0–3.5% tungsten. Nearly 50% of the tungsten in the alloy is converted to carbides. In applications where high $R_c$ hardness is desirable (for example, in bearing applications, and the like) the tungsten content is preferably at the upper end of the range. The carbon content is preferably also high to ensure carbide formation.

Vanadium provides extremely good carbides which drastically limit the γ-region. Roughly, 80% of the vanadium in the alloy is converted to carbides, the highest of the elements listed. The alloy composition preferably includes 1.5–3.0% vanadium, more preferably 2.0–2.4% vanadium.

Niobium yields good carbides and tends to stabilize the alloy. It provides resistance to low melting melt materials, such as aluminum and zinc. The alloy composition preferably includes 2.0–4.0% niobium, more preferably 2.8–3.2% niobium.

Nickel is undesirable because it belongs to the group of elements forming a continuous series of solid solutions with iron. Introduction of nickel into iron widens the γ-Fe region. For magnesium melts the nickel dissolves in the melt and lowers the temperature of the melt, such that the melt melts at a lower temperature. Thus, it is desirable to avoid even trace amounts of nickel in the alloy composition. Preferably, the nickel concentration is below about 0.005%. More preferably, the nickel concentration is 0%.

Similarly, manganese also widens the γ-Fe region, behaving very much like nickel. However, the presence of manganese improves the casting ability of the alloy composition. It is difficult to cast alloys with manganese concentration of below about 0.5%. Small amounts of manganese, around 0.5–1.0%, may be included in the composition to improve casting, without significant damaging effect on the alloy's performance.

The alloy may also contain small amounts of tantalum. Tantalum forms good carbides. However, at concentrations of over 1 to 1.5%, tantalum tends to make the alloy material unstable, resulting in warping and distortion. The alloy also becomes difficult to machine. Thus, the alloy preferably includes below 1.5% tantalum, more preferably below 1.0% tantalum.

To reduce the cost of components formed using the alloy, the components need not be formed entirely from the alloy, but rather, may have an outer layer of the alloy. For example, the component may comprise a cast outside layer made of the melt-resistant alloy, and an inner layer or liner of a material having different solubility and hardness characteristics from the outside layer. The high hardness and solubility resistance of the outer layer is not always necessary throughout the entire thickness of the component. In addition, the inner layer may also be used to provide different properties to the component from that of the outside layer, such as structural strength. For example, components may have an outer layer thickness of 0.1 to 2.5 cm and provide excellent protection against magnesium.

The following example is provided to indicate the properties which may be obtained with the magnesium-resistant alloy and is not intended to limit the scope of the invention.

EXAMPLE

An alloy was prepared having the following composition:

| ELEMENT | CONTENT (weight %) |
|---|---|
| Boron | 0.20–0.30 |
| Carbon | 0.50–0.60 |
| Sulfur | trace |
| Phosphorus | trace |
| Chromium | 10.0–11.0 |
| Silicon | less than 0.80 |
| Molybdenum | 6.00–7.00 |
| Tungsten | 3.00–3.5 |
| Vanadium | 2.00–2.40 |
| Niobium | 2.80–3.20 |
| Cobalt | 4.00–4.50 |
| Iron | Balance |

The alloy has good hardness, RM, tensile strength, and compression characteristics. Table 1 compares some of these properties with those of cast iron.

TABLE 1

| | | | Tensile Strength (KSI) | | | Compression Yield |
|---|---|---|---|---|---|---|
| Sample | Hardness | RM | 1000° F. | 1300° F. | Elong. | (KSI) |
| Cast Iron 20 | B160 | 23 | 15 | | | |
| Cast Iron 40 | B220 | 45 | 38 | | | |

TABLE 1-continued

| | | | Tensile Strength (KSI) | | | Compression Yield |
|---|---|---|---|---|---|---|
| Sample | Hardness | RM | 1000° F. | 1300° F. | Elong. | (KSI) |
| Alloy | C36 | 58 | 80 | 65 | 2.5 | 83.5 |

In addition, the alloy performed well in solubility testing. In one test, a sample of the material was subjected to the following regimen:

Two weeks in a molten metal bath comprising 93% Mg and 6% Al;

Four weeks frozen in the same bath, followed by a remelt of the bath; and

Two weeks in the bath following remelt.

The sample held up well at the melt line, even during a freeze and remelt.

A layer of magnesium salt, such as magnesium chloride, was used on the surface of the melt to reduce oxidation. The exterior, or outer surface, of the alloy sample picked up a marginal amount of the alkalide, due to the cleanup (metal treatment) following remelt. The first 0.1 mm layer, just beneath the exterior shell, picked up 1–7% magnesium in localized regions; the second layer, 0.1–0.2 mm below the surface, exhibited no evidence of pickup.

It is to be anticipated that where nitrogen atmospheres are used instead of the magnesium chloride to reduce oxidation of the melt, even this slight wetting would be eliminated.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A component of equipment for use in molten melts which include magnesium, the component formed from an alloy comprising, in terms of weight percent: iron,

| | |
|---|---|
| Boron | 0.20–0.30 |
| Carbon | 0.50–0.60 |
| Chromium | 10.0–11.0 |
| Silicon | 0.0–0.80 |
| Molybdenum | 6.0–7.0 |
| Tungsten | 3.00–3.50 |
| Vanadium | 2.00–2.40 |
| Nioblum | 2.00–2.40 |
| Cobalt | 4.00–4.5 |

the alloy being substantially free of sulfur and phosphorous.

* * * * *

UNITED STATES PATENT AND TRADEMARK OFFICE

CERTIFICATE OF CORRECTION

PATENT NO. : 6,899,772 B1
DATED : May 31, 2005
INVENTOR(S) : Jorge A. Morando

It is certified that error appears in the above-identified patent and that said Letters Patent is hereby corrected as shown below:

Title page,
Item [54], Title, replace "ALLOY MOLTEN COMPOSITION SUITABLE FOR MOLTEN MAGNESIUM ENVIRONMENTS." with -- ALLOY COMPOSITION SUITABLE FOR MOLTEN MAGNESIUM ENVIRONMENTS --.

Signed and Sealed this

Sixteenth Day of August, 2005

JON W. DUDAS
*Director of the United States Patent and Trademark Office*